US006119790A

United States Patent [19]

Hall

[11] Patent Number: 6,119,790

[45] Date of Patent: Sep. 19, 2000

[54] APPARATUS FOR LAYING A LAYER OF MATERIAL

[75] Inventor: David Hall, New Madden, United Kingdom

[73] Assignee: Thames Water Utilites Limited, United Kingdom

[21] Appl. No.: 08/984,508

[22] Filed: Dec. 3, 1997

[30] Foreign Application Priority Data

Apr. 12, 1996 [GB] United Kingdom ..... 9625176

[51] Int. Cl.[7] ..... A01C 5/08

[52] U.S. Cl. ..... 172/684.5

[58] Field of Search ..... 172/253, 817, 172/684.5; 37/407, 462; 414/912; 404/101, 110; 210/193, 223, 258, 259, 266; 222/556

[56] References Cited

U.S. PATENT DOCUMENTS

| | | | |
|---|---|---|---|
| 4,121,646 | 10/1978 | Rikker | 222/134 X |
| 4,710,054 | 12/1987 | Allen | 404/110 |
| 4,798,151 | 1/1989 | Rodrigues, Jr. et al. | 172/196 |
| 5,234,128 | 8/1993 | Hill | 222/63 |
| 5,806,604 | 9/1998 | Sanders | 172/4.5 |

*Primary Examiner*—Robert E. Pezzuto

*Attorney, Agent, or Firm*—Blakely Sokoloff Taylor & Zafman

[57] ABSTRACT

The invention relates to an apparatus for layering a layer of material, such as shingle or activated carbon, over a layer of material laid from a hopper. The apparatus comprises an auxiliary body to mount on the hopper and contain the first-mentioned material and a distributing device for distributing the first-mentioned material.

14 Claims, 3 Drawing Sheets

APPARATUS FOR LAYING A LAYER OF MATERIAL

The invention relates to apparatus for laying a layer of material superposed on a layer of material laid from a hopper.

Hoppers are often tiltable buckets which form part of a dumper or other item of mobile equipment which is used to lay for example, sand in a slow sand filter. However, such dumpers, or dumper trucks, cannot usually lay layers of two materials one on top of another, which can lead to delays in completing laying or reconstitution of filter media in a slow sand filter.

It is an object of the invention to seek to mitigate this disadvantage.

According to a first aspect of the invention there is provided apparatus for laying a layer of material superposed on a layer of material laid from a hopper, comprising an auxiliary body for the first mentioned material having means adapted for mounting on the hopper and a distributing device for distributing the first mentioned material.

The body may comprise a substantially flat receptacle for the first-mentioned material, and a feed device for feeding said material thereto, from above and the distributing device may comprise a plate inclined downwardly in use for delivering the first-mentioned material onto the second-mentioned material.

The mounting means may comprise opposed lugs projecting at substantially 90° to the plane of the sheet and on opposed positions thereon. This provides for a balanced mounting.

The angle of the plate may be adjustable during laying the first-mentioned material.

The angle of the plate may be adjustable by the plate being pivotable.

There may be stop means for stopping the pivoting of the plate at a desired angle. This construction provides for control of a thickness of a laid layer.

The stop means may be extensible stop means whereby to adjust the length thereof. This adjustable stop means may comprise manually rotatable screw threaded studs.

There may be means adapted for providing a smooth surface of the laid material. This construction can provide for smoothing out of tire, track or skid marks on a laid surface.

The said means may comprise a plough device.

The said means and body may comprise telescopically mountable means.

The telescopically mountable means may comprise rod means of the plough device and tube means of the body.

The plough device may be adjustable in position relative to the said means by adjustment means, which preferably may comprise screw adjustment means for bodily shifting the plough means.

According to a second aspect of the invention there is provided a dumper, in combination with apparatus as hereinbefore defined.

Apparatus embodying the invention is hereinafter described, by way of example, with reference to the accompanying drawings.

Figure 1:
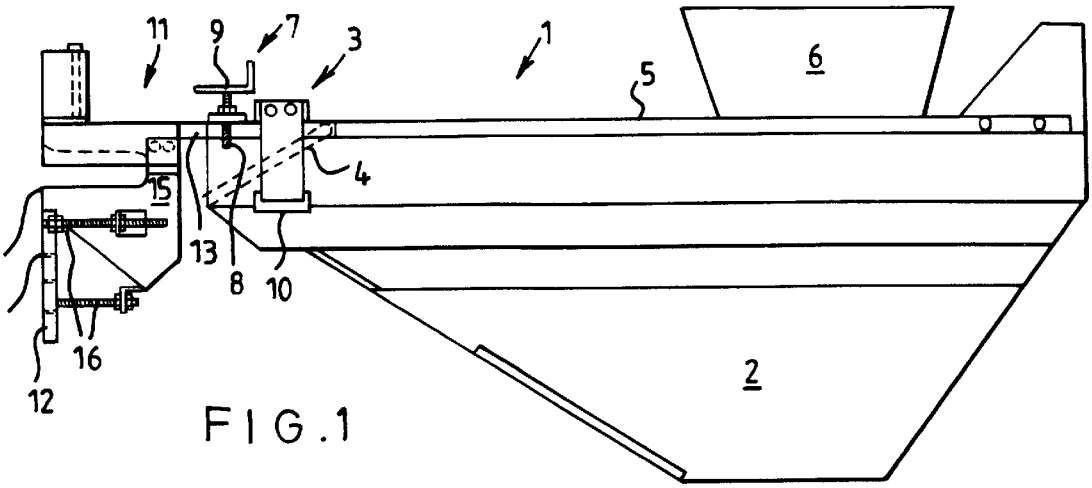
FIG. 1 is a side elevational view of apparatus according to the invention.
Figure 2:
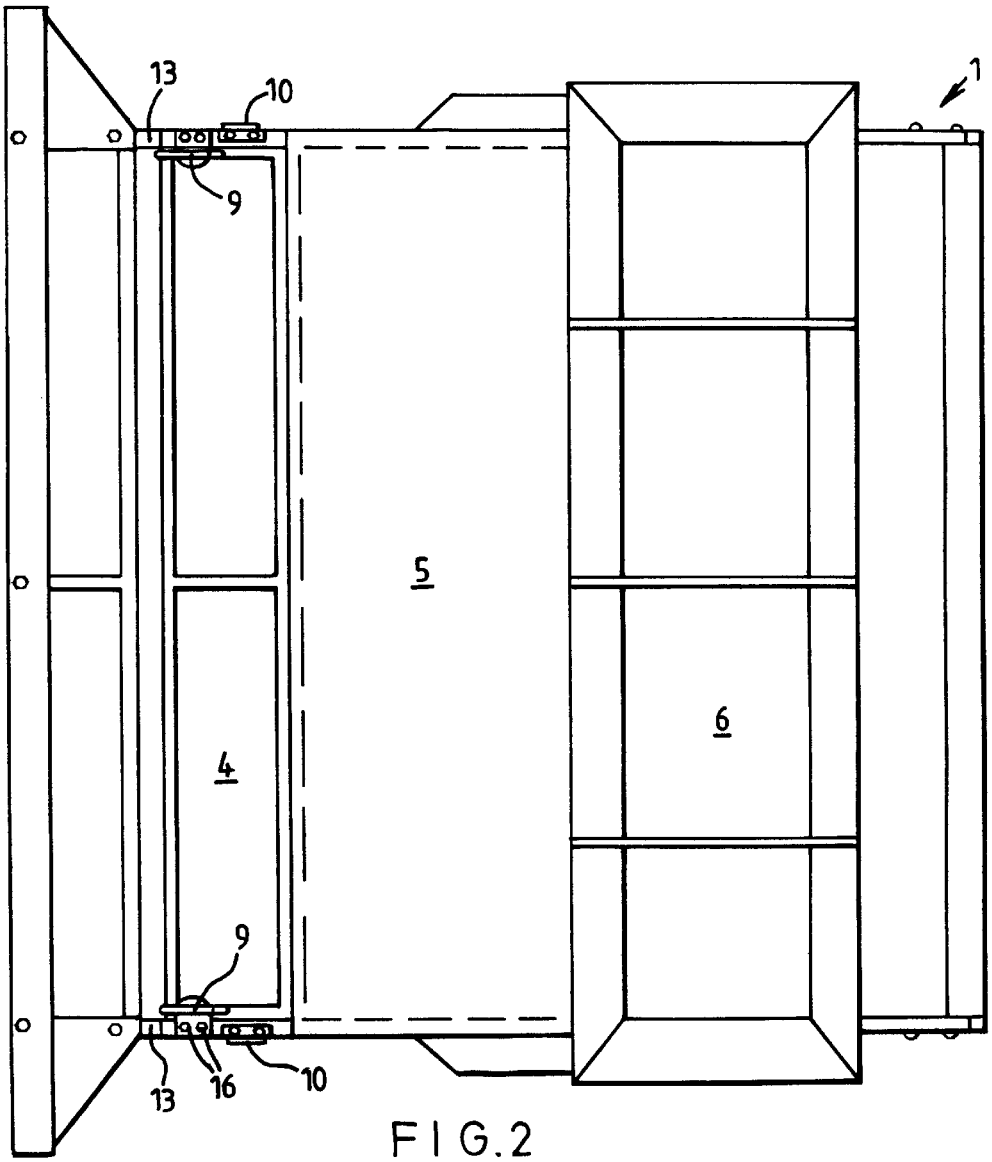
FIG. 2 is a plan view of the apparatus of FIG. 1.
Figure 3:
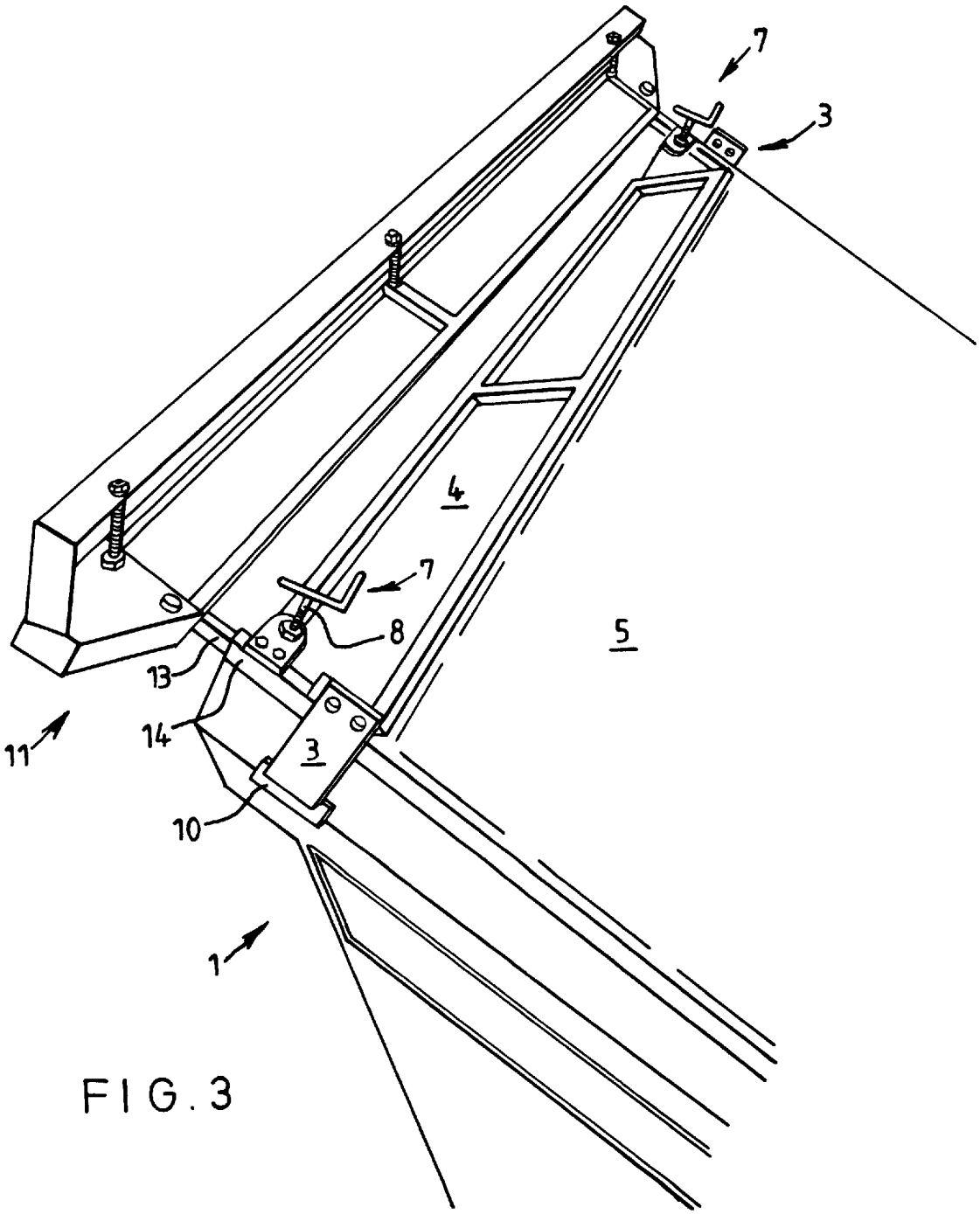
FIG. 3 is a perspective view of part of the apparatus of FIGS. 1 and 2 from above.
Figure 4:
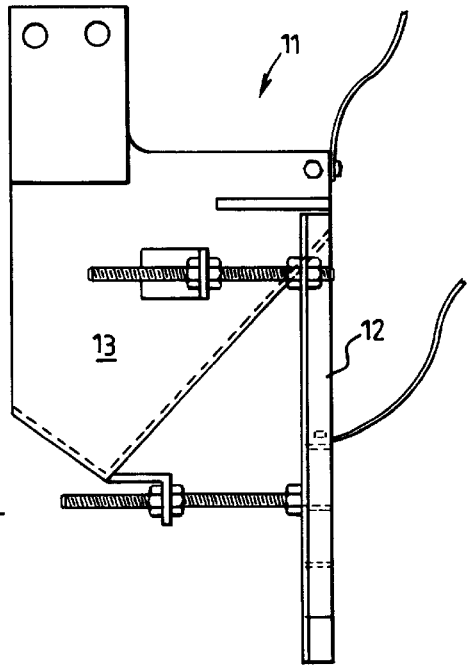
FIG. 4 is a side elevational view of part of the apparatus.
Figure 5:
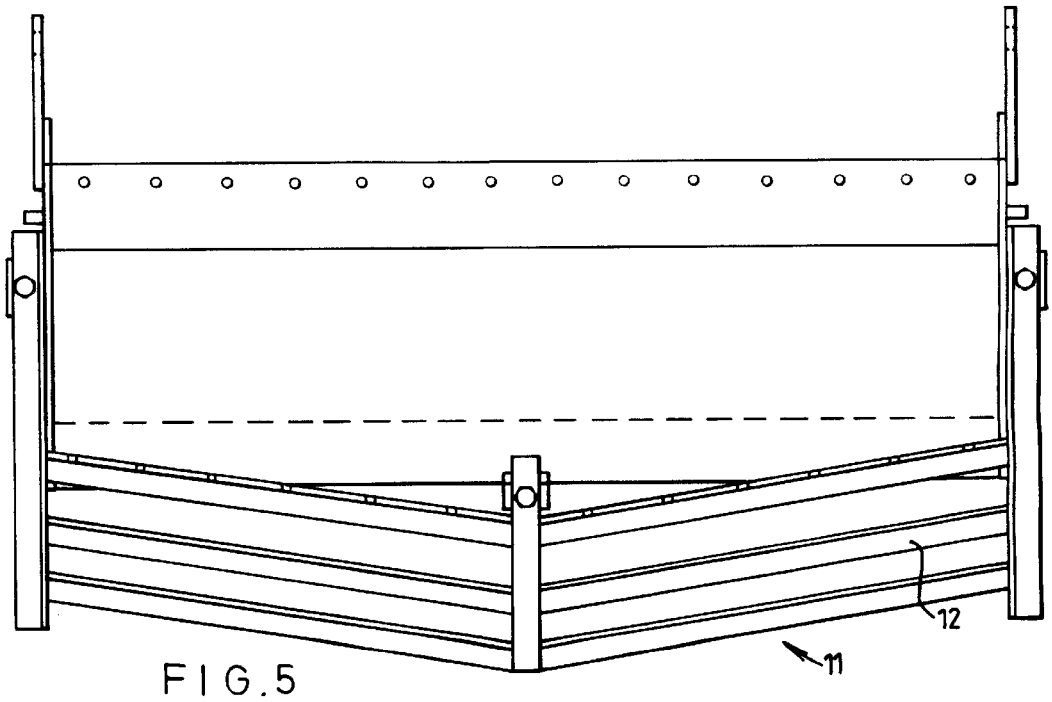
FIG. 5 is a front elevational view of the part of FIG. 4.

Referring to the drawings, there is shown apparatus 1 for laying a layer of material, such as shingle or activated carbon, over a layer of material laid from a hopper 2, comprising an auxiliary body for the first-mentioned material having means 3 adapted for mounting on the hopper 2 and a distributing device 4 for distributing the first-mentioned material.

The hopper 2 in the embodiment is a tiltable bucket of a mobile dumper unit which as a motor means and is usually driven by an operator sitting at controls (not shown).

The apparatus 1 has a body comprising a sheet or tray 5 which extends across the (open) top of the bucket 2 and has at its forward (in use) end a downwardly inclined chute or plate comprising the distributing means 4 pivotably mounted to the body so that as the bucket 2 tilts, so the plate 4 tilts to allow shingle or activated carbon to pass thereunder from the tray 5. The thickness of the distributed or laid layer is controlled by stop means 7 in the form of screw threaded rods or lugs 8 which are manually turnable by hand capstans 9 to raise or lower their free end which acts as an abutment against which the plate 4 abuts, thereby to control the thickness of the layer of shingle or activated carbon. Thus as the bucket 2 tilts, it deposits sand and at the same time the shingle or activated carbon is deposited on top as a superposed layer. The body of the apparatus 1 is mounted on the bucket by the mounting means 3 in the form of opposed lugs which extend from upstanding edges of the plate at substantially 90° to the plane of the tray 5 and seat in stirrups or brackets 10 on the bucket. The lugs 3 are therefore releasably mountable on the bucket.

There is also a means 11 for providing a smooth surface of the laid shingle or activated carbon which is therefore adapted for smoothing out wheel, tire, track or skid marks created by the dumper as it moves over the surface.

This means is in the form of a plough device 12 mounted, in the embodiment, by sliding rods 13 into tubes 14 at the sides of the tray 5, and holding them in position by respective studs or bolts 16 at each side. The plough device 12 extends between side cheeks 15 which include brackets through which threaded rods 16 pass which can be rotated, on loosening lock nuts, for bodily shifting of the plough device 12 for optimum smoothing out of tire etc. impressions.

The tray 5 may be made of hardboard, or any suitable material.

We claim:

1. Apparatus for laying a layer of material superposed on a layer of material laid from a hopper, comprising (i) a body comprising a substantially flat receptacle for the first-mentioned material;

(ii) means adapted for mounting said body on said hopper;

(iii) a feed device for feeding said first mentioned material to the body; and (iv) a distributing device comprising a plate adapted for delivery of the first mentioned material onto the second mentioned material.

2. A dumper, in combination with the apparatus according to claim 1.

3. Apparatus as defined in claim 1, wherein the mounting means comprises opposed lugs projecting at substantially 90° relative to the plane of the receptacle and on opposed positions thereon.

4. Apparatus as defined in claim 3, wherein the angle of the distributing device is adjustable while laying the first-mentioned material.

5. Apparatus as defined in claim 3, wherein the angle of the distributing device is adjustable by pivoting the plate.

6. Apparatus as defined in claim 5, wherein there is a stop means for stopping the pivoting of the plate at a desired angle.

7. Apparatus as defined in claim 6, wherein the length of the stop means may be adjusted.

8. Apparatus as defined in claim 7, wherein the stop means comprises manually rotatable screw threaded studs.

9. Apparatus as defined in claim 1, wherein there is means adapted for providing a smooth surface of the laid material.

10. Apparatus as defined in claim 9, wherein the means for providing a smooth surface comprises a plough device.

11. Apparatus as defined in claim 10, wherein the plough device and body are attached to one another by telescopic mounting means.

12. Apparatus as defined in claim 11, wherein the telescopic mounting means comprises rod means of the plough device and tube means of the body.

13. Apparatus as defined in claim 10, wherein the plough device is adjustable in position relative to the body by adjustment means.

14. Apparatus as defined in claim 13, wherein the adjustment means comprises screw adjustment means for bodily shifting the plough means.

* * * * *